US008646581B2

(12) United States Patent
Iwata et al.

(10) Patent No.: US 8,646,581 B2
(45) Date of Patent: Feb. 11, 2014

(54) ELEVATOR GROUP MANAGEMENT SYSTEM HAVING FELLOW PASSENGER GROUP ASSIGNMENT

(75) Inventors: Masafumi Iwata, Tokyo (JP); Naohiko Suzuki, Tokyo (JP); Shingo Kobori, Tokyo (JP); Sakurako Tokura, Tokyo (JP); Yoshimasa Koba, Tokyo (JP); Kouji Takeshima, Nagoya (JP); Masayuki Mitsuda, Nagoya (JP); Yoshinori Nonami, Nagoya (JP)

(73) Assignee: Mitsubishi Electric Corporation, Tokyo (JP)

( * ) Notice: Subject to any disclaimer, the term of this patent is extended or adjusted under 35 U.S.C. 154(b) by 363 days.

(21) Appl. No.: 13/061,649

(22) PCT Filed: Sep. 3, 2009

(86) PCT No.: PCT/JP2009/065405

§ 371 (c)(1), (2), (4) Date: Mar. 1, 2011

(87) PCT Pub. No.: WO2010/032625

PCT Pub. Date: Mar. 25, 2010

(65) Prior Publication Data

US 2011/0155514 A1 Jun. 30, 2011

(30) Foreign Application Priority Data

Sep. 19, 2008 (JP) ..... 2008-240106

(51) Int. Cl.
*B66B 1/18* (2006.01)

(52) U.S. Cl.
USPC ..... 187/387; 187/391; 187/396

(58) Field of Classification Search
USPC ..... 187/247, 380–389, 391–399
See application file for complete search history.

(56) References Cited

U.S. PATENT DOCUMENTS 4,915,197 A * 4/1990 Schroder ..... 187/380
5,248,860 A * 9/1993 Sirag, Jr. ..... 187/383

(Continued)

FOREIGN PATENT DOCUMENTS

CN 1054327 A 9/1991
CN 1688501 A 10/2005

(Continued)

OTHER PUBLICATIONS

German Office Action issued May 16, 2012, in German Patent Application No. 11 2009 002 258.8-22 (with English translation).

(Continued)

*Primary Examiner* — Anthony Salata
(74) *Attorney, Agent, or Firm* — Oblon, Spivak, McClelland, Maier & Neustadt, L.L.P.

(57) ABSTRACT

An elevator group management system capable of appropriately performing car assignment processing without leaving any one behind and enabling a passenger to recognize a car to board without fail. A fellow passenger group assignment section assigns fellow passenger groups to respective passengers based on the contents of hall call registration for each floor received from a hall operation panel, and causes the hall operation panel that has sent the hall call registration to display names of the assigned fellow passenger. A fellow passenger group car assignment section executes, on the fellow passenger groups assigned by the fellow passenger group assignment section, car assignment processing of assigning any of a plurality of cars as an assigned car and, in a case of determining the assigned car, provides car control sections with a passenger guide command containing at least combination information on this assigned car that has been determined and the fellow passenger group.

7 Claims, 15 Drawing Sheets

(56) References Cited

U.S. PATENT DOCUMENTS

| | | | | |
|---|---|---|---|---|
| 5,305,198 | A | 4/1994 | Schroder et al. | |
| 5,382,761 | A * | 1/1995 | Amano | 187/383 |
| 5,831,226 | A | 11/1998 | Hattori et al. | |
| 6,065,570 | A * | 5/2000 | Friedli et al. | 187/387 |
| 7,021,429 | B2 * | 4/2006 | Hikita | 187/398 |
| 7,036,635 | B2 * | 5/2006 | Rintala et al. | 187/396 |
| 7,040,458 | B2 * | 5/2006 | Forsythe et al. | 187/396 |
| 7,549,517 | B2 * | 6/2009 | Stanley et al. | 187/382 |
| 7,849,974 | B2 * | 12/2010 | Stanley et al. | 187/387 |
| 7,921,968 | B2 * | 4/2011 | Stanley et al. | 187/388 |
| 7,987,947 | B2 * | 8/2011 | Christy et al. | 187/249 |
| 8,151,943 | B2 * | 4/2012 | de Groot | 187/382 |
| 8,348,018 | B2 * | 1/2013 | Kostka | 187/249 |
| 2008/0041669 | A1 | 2/2008 | Sansevero et al. | |
| 2008/0289910 | A1 | 11/2008 | Christy et al. | |

FOREIGN PATENT DOCUMENTS

| | | |
|---|---|---|
| EP | 0 443 188 B1 | 8/1991 |
| EP | 1 549 581 B1 | 7/2005 |
| JP | 60 232379 | 11/1985 |
| JP | 61 75777 | 4/1986 |
| JP | 3-143881 A | 6/1991 |
| JP | 5 201630 | 8/1993 |
| JP | 2563545 | 9/1996 |
| JP | 9 315708 | 12/1997 |
| JP | 2000 219443 | 8/2000 |
| JP | 2000-272850 A | 10/2000 |
| JP | 2000-272851 A | 10/2000 |
| JP | 2005-187162 A | 7/2005 |
| JP | 2008 515742 | 5/2008 |
| JP | 2008 162764 | 7/2008 |
| JP | 2003 12249 | 1/2009 |
| WO | 03 000579 | 1/2003 |
| WO | 2007 070054 | 6/2007 |
| WO | 2009 123014 | 10/2009 |

OTHER PUBLICATIONS

Office Action issued Jun. 28, 2012 in Korean Patent Application No. 10-2011-7006150 (with partial English-language translation).
U.S. Appl. No. 13/395,909, filed Mar. 14, 2012, Koba.
U.S. Appl. No. 13/496,048, filed Mar. 14, 2012, Koba, et al.
International Search Report Issued Nov. 24, 2009 in PCT/JP09/065405 filed Sep. 3, 2009.
Combined Chinese Office Action and Search Report Issued Oct. 26, 2012 in Patent Application No. 200980136651.0 (with partial English translation and Japanese translation).
Japanese Office Action Issued Feb. 19, 2013 in Patent Application No. 2010-529716 (with partial English translation).
Japanese Office Action issued Jun. 4, 2013 in Patent Application No. 2010-529716 with Partial English Translation.

* cited by examiner

F I G . 1

| PASSENGER NUMBER | DESTINATION FLOOR | ASSIGNED FELLOW PASSENGER GROUP | ASSIGNED CAR |
|---|---|---|---|
| 1 | 10 | A | 1 |
| 2 | 8 | B | 2 |
| 3 | 10 | A | 1 |
| 4 | 4 | A | 1 |
| 5 | 11 | A | 1 |
| 6 | 6 | B | 2 |
| 7 | 3 | A | 1 |
| 8 | 16 | B | 2 |
| 9 | 17 | B | 2 |
| 10 | 3 | B | 2 |

F I G . 2

| PASSENGER NUMBER | DESTINATION FLOOR | ASSIGNED FELLOW PASSENGER GROUP | ASSIGNED CAR |
|---|---|---|---|
| 1 | 10 | A | 1 |
| 2 | 8 | B | 2 |
| 3 | 10 | A | 1 |
| 4 | 4 | C | 1 |
| 5 | 11 | A | 1 |
| 6 | 6 | B | 2 |
| 7 | 3 | C | 1 |
| 8 | 16 | B | 2 |
| 9 | 17 | B | 2 |
| 10 | 3 | D | 2 |

F I G . 3

| PASSENGER NUMBER | DESTINATION FLOOR | ASSIGNED FELLOW PASSENGER GROUP | ASSIGNED CAR | | |
|---|---|---|---|---|---|
| | | | THIS TIME | NEXT TIME | SUBSEQUENT TIME |
| 1 | 10 | A | 1 | | |
| 2 | 8 | B | 2 | | |
| 3 | 10 | A | 1 | | |
| 4 | 4 | C | | 1 | |
| 5 | 11 | A | 1 | | |
| 6 | 6 | B | 2 | | |
| 7 | 3 | C | | 1 | |
| 8 | 16 | B | 2 | | |
| 9 | 17 | B | 2 | | |
| 10 | 3 | D | | 2 | |

ELEVATOR GROUP MANAGEMENT SYSTEM HAVING FELLOW PASSENGER GROUP ASSIGNMENT

TECHNICAL FIELD

The present invention relates to an elevator group management system that efficiently operates a plurality of elevators.

BACKGROUND ART

In an elevator group management system that receives destination floors using a predetermined operation panel and guides an assigned car according to the destination floors in an elevator hall or a remote location relatively apart from the elevator hall, the methods disclosed in Patent Documents 1 to 3 are typically adopted as the method of guiding an assigned car.

Patent Document 1 discloses the method of displaying an assigned car on a display arranged in proximity to a hall call button for a certain period of time after a passenger depresses a hall call button (first method).

Further, Patent Document 2 discloses the method of displaying destination floors of a car assigned according to destinations above a car door (second method).

Further, there is the method disclosed in Patent Document 3 as the third method that is the guiding method obtained by combining the above-mentioned first and second methods.

Further, Patent Document 4 discloses that an assignment change is shown by chiming or lighting when an assigned car is changed.

Further, Patent Documents 5 to 8 are each directed to grouping of destination floors to limit car assignment therefor. Patent Document 8 describes review of assignment, where a change can be only made in units of destination floors. In addition, a destination floor is noticed by other people, which leads to a security problem.

PRIOR ART DOCUMENT

Patent Document

Patent Document 1: Japanese Patent No. 2563545

Patent Document 2: Japanese Patent Application Laid-Open No. 09-315708

Patent Document 3: WO 2003/000579

Patent Document 4: Japanese Patent Application Laid-Open No. 2003-12249

Patent Document 5: Japanese Patent Application Laid-Open No. 60-232379

Patent Document 6: Japanese Patent Application Laid-Open No. 61-075777

Patent Document 7: Japanese Patent Application Laid-Open No. 05-201630

Patent Document 8: Japanese Patent Application Laid-Open No. 2000-219443

SUMMARY OF THE INVENTION

Problems to be Solved by the Invention

As described above, the conventional technologies adopt the method of guiding an assigned car in which a car assigned according to destination floors is displayed for each person immediately after call registration is made or display is made so as to be recognizable to all passengers in proximity to the car (door) or next to a floor destination call button.

In the conventional method of guiding an assigned car described above, the first method has a problem that it cannot cope with review or change of an assigned car after car assignment.

In the second method, assignment of cars according to destination floors is assumed, and thus there arises a problem that, for example, in a case where passengers who intend to go to the same destination floor, which exceed the capacity thereof, board a car, some of them are left behind.

Further, in the second method, a display on the door of the car displays the assignment situation of destination floors for each car, leading to a security problem that destination floors of the car cannot be made secret and thus the destination floors of passengers are easily noticed by others.

In the third method, an assigned car is displayed on the display in proximity to a floor call button for a certain period of time after a passenger depresses the floor call button as in the first method, which is not adaptable to later review or change of an assigned car. In addition, the assignment situation of destination floors is displayed for each car as in the second method, leading to a security problem that the destination floors of passengers are easily noticed by others.

Further, in all of the first to third methods described above, the information on an assigned car to be displayed contains only the information for distinguishing assigned cars, and thus it is not possible to make assignment differently between when the same car arrives this time and when the same car arrives next time. In addition, it is required to assume a case where assignments with different destination directions are made to the same car, and accordingly a passenger has to board a car by checking the arrival direction of the car, leading to a problem that the passenger bears the burden of recognizing an assigned car.

Further, according to Patent Document 4, in a case where assignment is changed, the assignment change is merely displayed by chiming or lighting, which leads to a problem that, in a case where cars are assigned according to a plurality of destination floors, the assignment in which change has been made cannot be easily recognized.

As described above, when an elevator group is managed based on the conventional method of guiding assigned cars, it is difficult to appropriately perform car assignment processing without leaving any one behind, leading to a problem that a passenger has difficulty in recognizing a car to board without fail. Moreover, it is difficult to change car assignment in a practical manner, leading to a security problem.

The present invention has been made to solve the above-mentioned problems, and an object thereof is to obtain an elevator group management system capable of appropriately performing car assignment processing without leaving any one behind in which a passenger is capable of recognizing a car to board without fail.

Means to Solve the Problem

An elevator group management system according to the present invention assigns, in an elevator group including a plurality of cars, any of the plurality of cars to passengers in response to demands of the passengers to manage the cars, which includes: a hall call registration section located in an elevator hall or in proximity thereto and capable of performing hall call registration of registering destination floors by the passengers; a fellow passenger group assignment section assigning passengers to fellow passenger groups each time the hall call registration is made, and causing a fellow passenger group display section to display fellow passenger group information thereof, the fellow passenger group display section being disposed in proximity to the hall call registration section; and a fellow passenger group car assignment section executing car assignment processing of assigning at least one of the fellow passenger groups to any of the plurality of cars as an assigned car and generating a passenger guide command indicating at least a correspondence relationship between the fellow passenger group and the assigned car.

Note that the "group" described herein refers to grouping of individual passengers, not to grouping of destination floors. Therefore, for example, in a case where lots of passengers who start from the same floor and go to the same floor cannot be accommodated in one car, it is possible to assign those passengers to different groups. Further, it is possible for passengers to recognize the groups to belong to by making assigned cars and groups independent of each other after call is made. After that, the elevator group management system is capable of showing a car that passengers of each group should onboard during the most desirable period in consideration of efficiency and serviceability. Further, destination floors are not displayed in the car, and the operation for recognizing the group to board is required for all users, and hence the elevator group management system is capable of accurately recognizing the expected number of passengers. Accordingly, it is possible to improve the operational efficiency.

Effects of the Invention

The elevator group management system according to the present invention assigns cars by the fellow passenger group car assignment section in units of fellow passenger groups, and accordingly is capable of setting even passengers from the same boarding floor to the same destination floor to different fellow passenger groups. Therefore, even in a case of a large number of passengers from the same boarding floor to the same destination floor, it is possible to appropriately perform car assignment processing without leaving any one behind.

These and other objects, features, aspects and advantages of the present invention will become more apparent from the following detailed description of the present invention when taken in conjunction with the accompanying drawings.

BRIEF DESCRIPTION OF DRAWINGS

FIG. 1 shows a first example of the relationship between a fellow passenger group and an assigned car on a certain boarding floor in table form.

FIG. 2 shows a second example of the relationship between a fellow passenger group and an assigned car on a certain boarding floor in table form.

FIG. 3 shows a third example of the relationship between a fellow passenger group and an assigned car on a certain boarding floor in table form.

EMBODIMENT FOR CARRYING OUT THE INVENTION

<Premise>

Figure 4:
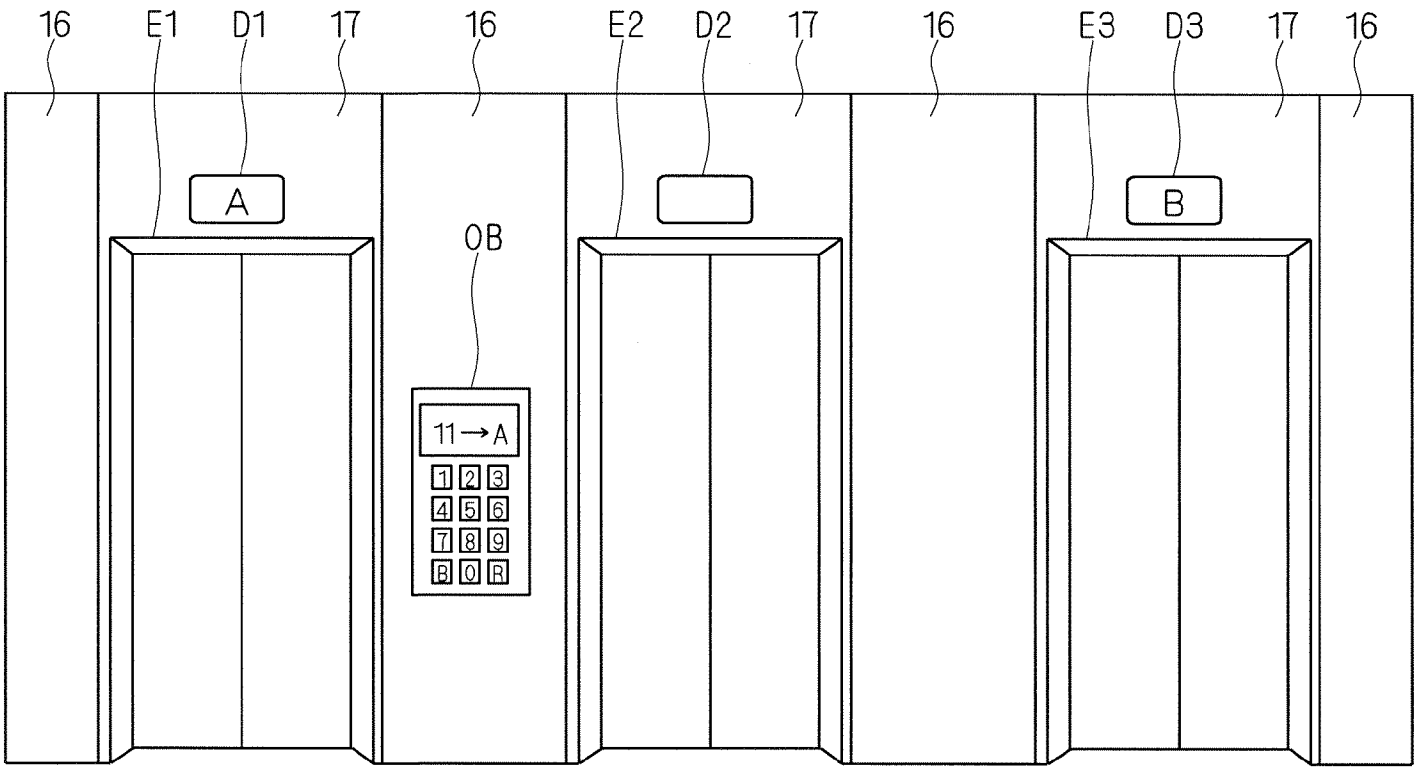
FIG. 4 is an explanatory view showing a first configuration example of a device set in proximity to an elevator hall in an elevator group management system according to an embodiment.

An elevator group management system according to an embodiment of the present invention will be described. The present embodiment is applied to an elevator group management system in which a passenger designates a destination floor in an elevator hall and performs hall call registration (where a combination of a boarding floor and a destination floor is registered).

That is, in the elevator group management system according to the embodiment, when a passenger performs hall call registration, first, one fellow passenger group is inevitably assigned to the passenger. Then, a car is assigned to the fellow passenger group before an elevator arrives. The fellow passenger group refers to a group of people boarding a car together.

<Contents Assigned to Fellow Passenger Group>

FIG. 1 to FIG. 3 show first to third examples showing the relationship between a fellow passenger group and an assigned car on a certain boarding floor in table form. In FIG. 1 to FIG. 3, a passenger number refers to the number for identifying a passenger who has performed floor call registration, which serves as the number displaying each individual passenger. Note that the first to third examples show the relationship between a fellow passenger group and an assigned car in a case where hall call registration is made on the same boarding floor.

As shown in FIG. 1, boarding cars are assigned such that passengers (passenger numbers 1, 3 to 5, 7) assigned to a fellow passenger group A are assigned to a car No. 1 and passengers (passenger numbers 2, 6, 8 to 10) assigned to a fellow passenger group B are assigned to a car No. 2. That is, fellow passenger groups and assigned cars are brought into correspondence with each other one by one in the first example shown in FIG. 1.

In this case, it is possible to cause passengers whose destination floor is the same (third floor) as in the case of the passenger number 7 and the passenger number 10 to board different cars by assigning those to different fellow passenger groups.

Further, as shown in FIG. 2, a fellow passenger group A (passenger numbers 1, 3, 5) and a fellow passenger group C (passenger numbers 4, 7) are assigned to the car No. 1, and a fellow passenger group B (passenger numbers 2, 6, 8, 9) and a fellow passenger group D (passenger number 10) are assigned to the car No. 2. That is, in the second example shown in FIG. 2, a plurality of fellow passenger groups are assigned to the same car. That is, the second example of FIG. 2 shows the configuration capable of assigning, to passengers, any of four types of fellow passenger groups A to D exceeding two that is the number of ears.

Further, as shown in FIG. 3, the fellow passenger group A (passenger numbers 1, 3, 5) and the fellow passenger group B (passenger numbers 2, 6, 8, 9) are assigned to the car No. 1 and the car No. 2 this time, respectively and the fellow passenger group C (passenger numbers 4, 7) and the fellow passenger group D (passenger number 10) are assigned to the car No. 1 and the car No. 2 next time, respectively. That is, the fellow passenger groups and the assigned cars are brought into correspondence with each other one by one in the third example shown in FIG. 3. On this occasion, classification according to arrival turns is also performed in which boarding is made for the same assigned car. Accordingly, even for the same assigned car, it is possible to make assignment according to arrival turns such as this arrival, the next arrival and the subsequent arrival. Therefore, in the third example, a combination of any of a plurality of cars and its arrival turn is assigned as an assigned car.

While the description has been given of examples of fellow passenger groups on the same boarding floor in the first to third examples, fellow passenger groups may be formed so as to include passengers on different floors.

Elevator Hall (First Configuration Example)

FIG. 4 is an explanatory view showing a first configuration example of a device set in proximity to an elevator hall in an elevator group management system according to the embodiment. As shown in this figure, three car doors E1 to E3 are provided in the elevator hall, and fellow passenger group assigned car displays D1 to D3 are provided on sidewall parts 17 above the car doors E1 to E3. Provided on the sidewall between the car doors E1 and E2 is a hall operation panel OB. Note that the car doors E1 to E3 are provided correspondingly to elevators EV1 to EV3 (not shown).

Alternatively, the hall operation panel OB may be provided in the vicinity of an entrance to the elevator hall on the floor, outside the elevator hall, or in a place far from the elevator hall. Still alternatively, in some cases, a plurality of cars are provided in one shaft, such as a double-deck (elevator consisting of two-story car) and a one-shaft multi-car (elevator in which a plurality of cars are provided in one shaft), where the cars are separated out into a plurality types of boarding floors. In such a case, the hall operation panel OB may be provided in front of the moving means for at least one of a plurality of boarding floors, that is, stairs or an escalator. If the hall operation panel OB is provided in this manner, even in a case where a passenger is required to move, depending on a destination floor, from the present floor to an actual boarding floor that is another floor for boarding, it is possible to operate the hall operation panel OB at a previous stage for using moving means to an actual boarding floor.

<Hall Operation Panel>

Figure 5:
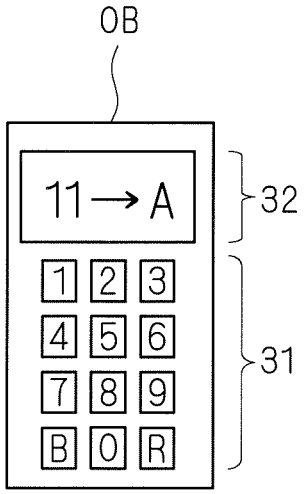
FIG. 5 is an explanatory view showing a configuration of a hall operation panel OB shown in FIG. 4.

FIG. 5 is an explanatory view showing the configuration of the hall operation panel OB shown in FIG. 4. As shown in this figure, the hall operation panel OB is composed of a destination floor input ten-key button 31 (hall call registration section) and a fellow passenger group display section 32. A passenger is capable of inputting a destination floor using the destination floor input ten-key button 31 and recognizing an assigned fellow passenger group by referring to the fellow passenger group display section 32. In the example of FIG. 5, it is possible to enable a passenger who has input an eleventh floor as a destination floor to visually recognize by the fellow passenger group display section 32 that the fellow passenger group A is assigned.

The fellow passenger group is displayed on the fellow passenger group display section 32 for a certain period of time immediately after a passenger operates the destination floor input ten-key button 31 and makes hall call registration for inputting a destination floor. Alternatively, display of a fellow passenger group may be continued by the fellow passenger group display section 32 until the next passenger inputs a destination floor.

Figure 6:
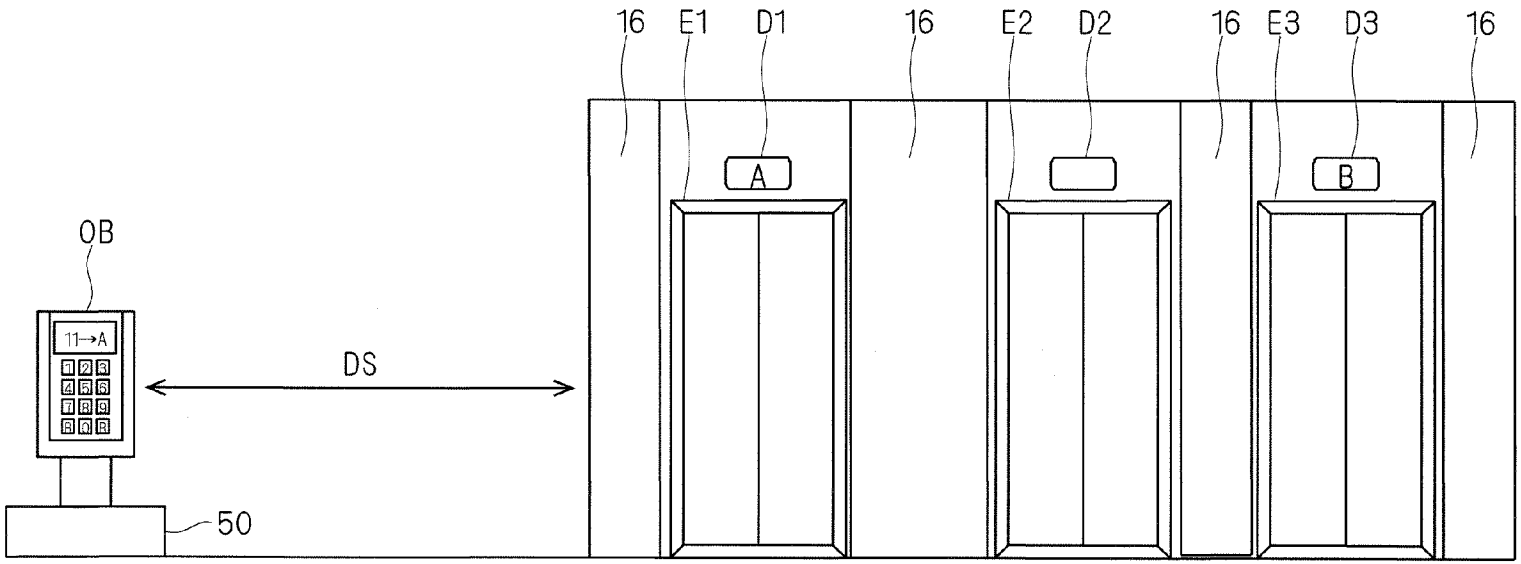
FIG. 6 is an explanatory view showing an installation example of the hall operation panel OB shown in FIG. 4.

While FIG. 4 shows the configuration example in which the hall operation panel OB is provided in the elevator hall, the hall operation panel OB may be provided on an operation panel mounting stage 50 in a place predetermined distance DS away from the elevator hall, as shown in FIG. 6.

Further, while the present embodiment describes the hall operation panel OB in which the destination floor input ten-key button 31 and the fellow passenger group display section 32 are integrated, the configuration may be made such that a device equivalent to the destination floor input ten-key button 31 and a device equivalent to the fellow passenger group display section 32 are independently provided to be disposed close to each other.

Further, the destination floor input ten-key button 31 may be readers such as a magnetic card, IC card, radio frequency identification (RFID) which store in advance the identification (ID) in which a start floor and a destination floor are associated with each other, such as call from an entrance floor to a residential floor. In this case, the ID is presented by causing the reader to read the magnetic card, IC card, RFID or the like, and a destination floor corresponding to a start floor on which the reader is installed is designated, whereby a hall call is registered.

Further, the method of presenting the ID may employ biometrics authentication such as fingerprint authentication and face authentication.

<Configuration of Elevator Group Management System>

Figure 7:
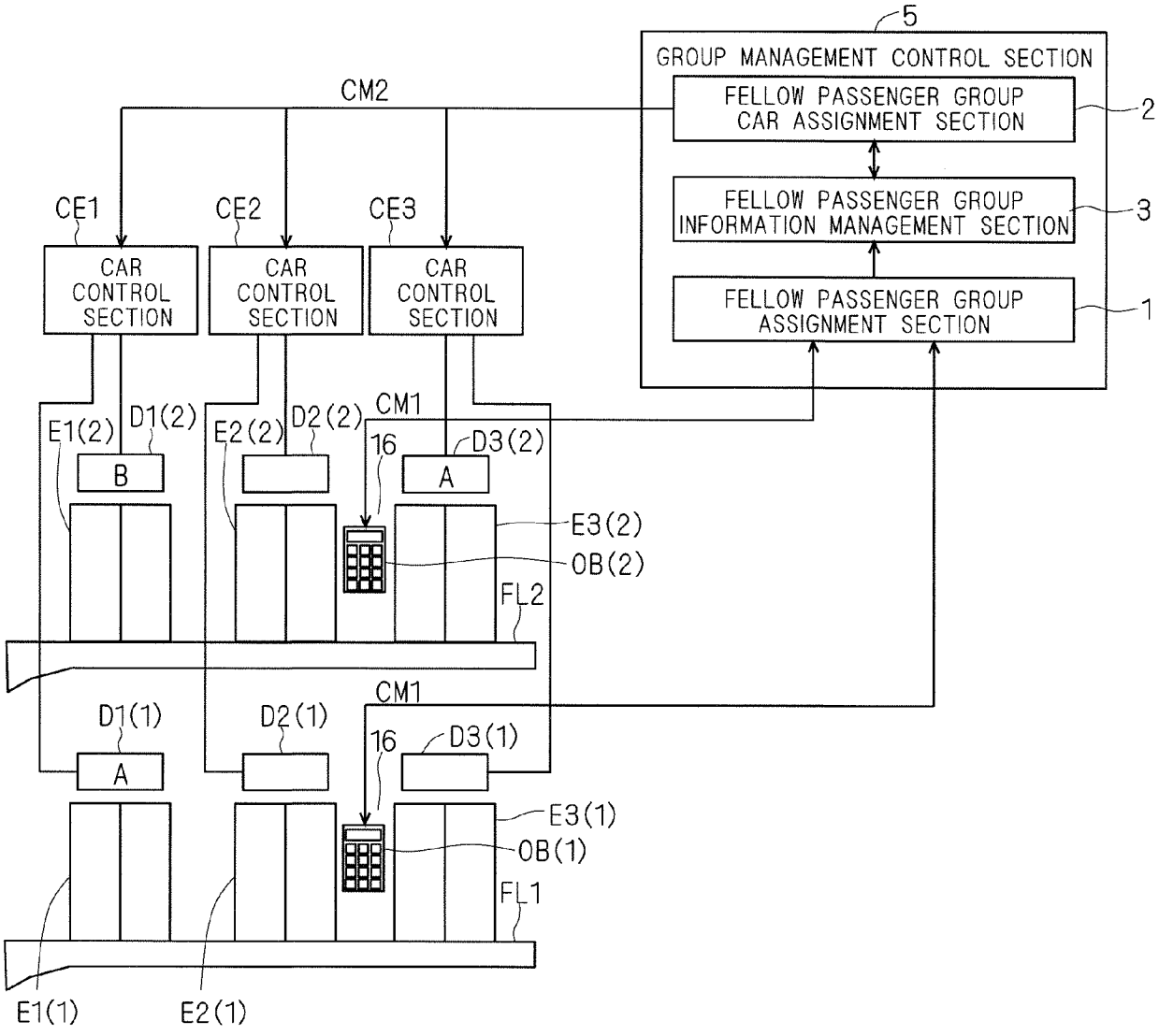
FIG. 7 is an explanatory diagram showing a configuration of the elevator group management system according to the embodiment of the present invention.

FIG. 7 is an explanatory view showing the configuration of the elevator group management system according to the embodiment of the present invention. As shown in this figure, car doors E1(1) to E3(1) are provided on a first floor FL1, fellow passenger group assigned car displays D1(1) to D3(1) are provided above the car doors E1(1) to E3(1), and a floor operation panel OB(1) is provided in a sidewall part 16 between the car doors E2(1) and E3(1).

Similarly, car doors E1(2) to E3(2) are provided on a second floor FL2, fellow passenger group assigned car displays D1(2) to D3(2) are provided above the car doors E1(2) to E3(2), and a hall operation panel OB (2) is provided in a sidewall part 16 between the car doors E2(2) and E3(2). Note that the configurations of the hall operation panels OB(1) and OB(2) are respectively similar to that of the hall operation panel. OB shown in FIG. 5.

Alternatively, similarly to the hall operation panel OB, the hall operation panels OB(1) and OB(2) on those floors may be provided in the vicinity of the entrance to the elevator hall, outside the elevator hall, or in a place apart from the elevator hall. Still alternatively, in a case where a plurality of cars are provided in one shaft, such as a double deck and a one-shaft multi-car and the cars are spread out into a plurality of types of boarding floors, the hall operation panel OB may be provided in front of the moving means to at least one of the plurality of types of boarding floors.

Further, while FIG. 7 shows only the first floor FL1 and the second floor FL2 for the sake of convenience, respective floors have a similar configuration in actuality, where car doors E1(*i*) to E3(*i*), fellow passenger group assigned car displays D1(*i*) to D3(*i*) and a hall operation panel OB(i) are installed on an i-th floor FLi. That is, car doors and fellow passenger group assigned car displays are provided for each elevator shaft and each floor FLi, and a hall operation panel is provided for each floor FLi.

The hall operation panel OB(i) including the hall operation panels OB(1) and OB(2) is connected to a fellow passenger group assignment section 1 in a group management control section 5, and the contents of hall call registration registered by operation of the destination floor input ten-key button 31 of the hall operation panel OB(i) are sent to the fellow passenger group assignment section 1.

Further, the operations of the elevators EV1 to EV3 (not shown) each moving up and down through each elevator shaft are controlled by car control sections CE1 to CE3. The elevators EV1 to EV3 are capable of receiving and discharging passengers through the car doors E1(*i*) to E3(*i*).

The group management control section 5 mainly includes the fellow passenger group assignment section 1, a fellow passenger group car assignment section 2 and a fellow passenger group information management section 3, and the fellow passenger group assignment section 1 assigns fellow passenger groups to respective passengers based on the contents of hall call registration for each floor FLi that is received from the hall operation panel OB(i). Then, the fellow passenger group assignment section 1 registers, in the fellow passenger group information management section 3, registered fellow passenger group information IM1 in which the assigned fellow passenger groups and the contents of hall registration call are specified.

Further, the fellow passenger group assignment section 1 provides a display command CM1 containing the registered fellow passenger group information IM1 to the hall operation panel OB(i) that has sent the hall call registration, to thereby cause the fellow passenger group display section 32 to display a fellow passenger group name that has been assigned.

The fellow passenger group car assignment section 2 executes car assignment processing based on the registered fellow passenger group information IM1 registered in the fellow passenger group information management section 3 or car assigned fellow passenger group information IM2 described below.

The ear assignment processing includes new assignment processing for a registered fellow passenger group to which a car specified by the registered fellow passenger group information IM1 has not been assigned, assignment contents review processing for an assigned fellow passenger group in which a car is specified by the car assigned fellow passenger group information IM2, and assigned car determination processing of determining an assigned car assigned to the assigned fellow passenger group. Note that the information on the fellow passenger group to which an assigned car is assigned by the new assignment processing is registered as the car assigned fellow passenger group information IM2 in the fellow passenger group information management section 3.

The fellow passenger group car assignment section 2 sends control commands to the car control sections CE1 to CE3 such that cars are operated according to the contents specified by the car assigned fellow passenger group information IM2. The control command is sent in a case where the car assigned fellow passenger group information IM2 is newly generated by the new assignment processing, and in a case where the contents of the car assigned fellow passenger group information IM2 are changed by the assignment contents review processing.

In a case where an assigned car is determined by the assigned car determination processing, the fellow passenger group car assignment section 2 generates a passenger guide command CM2 containing at least combination information on an assigned car that has been determined and a fellow passenger group that uses the assigned car that has been determined based on the car assigned fellow passenger group information IM2 in which the assigned car that has been determined is specified, and provides the passenger guide command CM2 to the car control sections CE1 to CE3.

The car control sections CE1 to CE3 that have received the passenger guide command CM2 cause the fellow passenger group assigned car displays D1(1) to D3(1) and D1(2) to D3(2) to display fellow passenger groups and the like, so that the fellow passenger groups specified in the passenger guide command CM2 are capable of entering and leaving cars with the use of the assigned cars that have been determined.

In this manner, the car control sections CE1 to CE3 perform operation control of the elevators EV1 to EV3 based on the control command from the fellow passenger group car assignment section 2 and passenger guide display control of displaying fellow passenger groups and the like on the fellow passenger group assigned car displays D1(1) to D3(1) and the like based on the passenger guide command CM2 from the fellow passenger group car assignment section 2.

<Fellow Passenger Group Assignment Processing>

Figure 8:
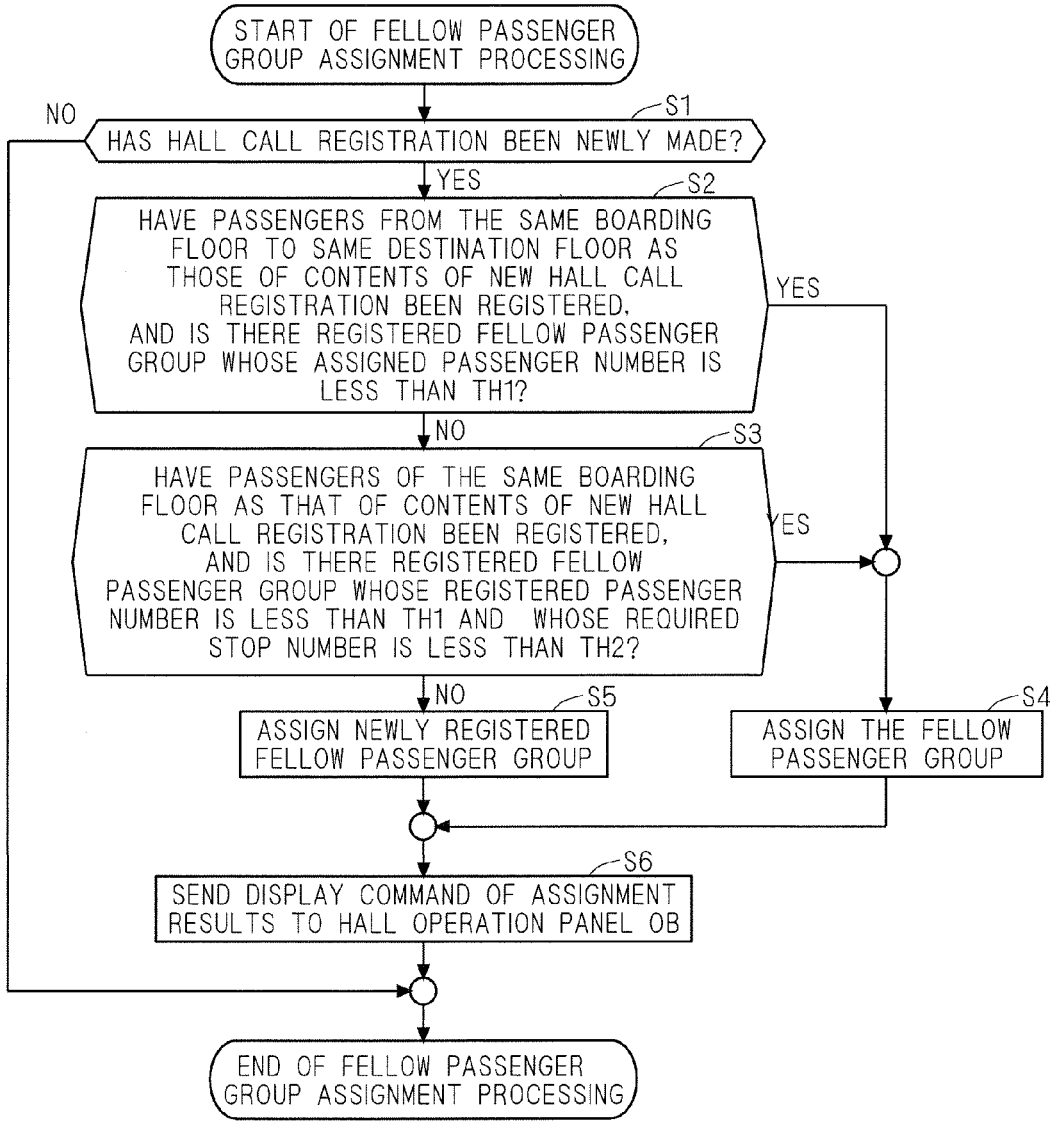
FIG. 8 is a flowchart showing a processing procedure of fellow passenger group assignment processing by a fellow passenger group assignment section shown in FIG. 7.

FIG. 8 is a flowchart showing a processing procedure of the fellow passenger group assignment processing by the fellow passenger group assignment section 1 shown in FIG. 7. The fellow passenger group assignment processing by the fellow passenger group assignment section 1 is executed every time a passenger performs hall call registration using the hall operation panel OB(i).

With reference to this figure, in Step S1, it is checked whether new hall call registration is made (YES) or not (NO) and, in the case of NO, the processing is ended.

On the other hand, in the case of YES in Step S1, the process proceeds to Step S2. In Step S2, in a case where a fellow passenger group for passengers from the same boarding floor to the same destination floor as those of the new hall call registration contents has been assigned and registered as the registered fellow passenger group information IM1 in the fellow passenger group information management section 3, this registered fellow passenger group is selected as an assigned fellow passenger group candidate.

Then, in a case where the number of assigned passengers of assigned fellow passenger group candidate is smaller than a predetermined passenger number TH1 (YES), the process proceeds to Step S4, whereas in a case where the number is equal to or larger than the predetermined passenger number TH1, the process proceeds to Step S3. Note that the predetermined passenger number TH1 is set to a value equal to or larger than "1" and smaller than the capacity of the car or to the capacity.

In a case where the number of passengers to which the assigned fellow passenger group has been assigned is a value close to the capacity, options of cars that can be assigned by the fellow passenger group assignment section 1 become fewer. In a case where the number of passengers to which an assigned fellow passenger group has been assigned is small and in a case where only one assigned fellow passenger group is allowed to be assigned to one car as shown in FIG. 1, the number of passengers who can board a car at one time becomes fewer, which deteriorates operational efficiency. Therefore, it is desired that the predetermined passenger number TH1 be set to a relatively large value in the case of FIG. 1 and to a relatively small value in the cases of FIG. 2 and FIG. 3.

In Step S3 that is executed in the case of NO in Step S2, in a case where the fellow passenger group for passengers from the same boarding floor to a destination floor in the same direction as those of the contents of new hall call registration has been assigned as the registered fellow passenger group information IM1 and registered in the fellow passenger group information management section 3, this registered fellow passenger group is selected as an assigned fellow passenger group candidate.

Then, in a case where the assigned passenger number of the assigned fellow passenger group candidate is less than the predetermined passenger number TH1 and the required stop number of the elevator that the assigned fellow passenger group candidate board is less than a predetermined stop number TH2 (YES), the process proceeds to Step S4. On the other hand, in a case where the assigned fellow passenger group candidate does not satisfy the above-mentioned conditions or the assigned fellow passenger group candidate is not selected (NO) in Step S3, the process proceeds to Step S5. Note that the required stop number refers to a sum of boarding floors and destination floors of the passengers that have been assigned to the assigned fellow passenger group candidate. Alternatively, the required stop number may be a value computed according to the running direction.

In Step S4 executed in a case of YES in Step S2 or Step S3, the assigned fellow passenger group candidate selected in Step S2 or Step S3 is assigned to passengers who have performed new hall call registration as a fellow passenger group for passengers who have performed new hall call registration, and the registered fellow passenger group information IM1 in which the contents thereof are specified is registered again in the fellow passenger group information management section 3. Then, the process proceeds to Step S6.

In Step S5 executed in the case of NO in Step S3, a new fellow passenger group other than the fellow passenger group registered in the fellow passenger group information management section 3 is assigned as a fellow passenger group for passengers who have performed new hall call registration, and the information where the contents thereof are specified is registered in the fellow passenger group information management section 3 as new registered fellow passenger group information IM1. Then, the process proceeds to Step S6.

In Step S6 executed after Step S4 or Step S5, the display command CM1 containing the registered fellow passenger group information IM1 is sent to the hall operation panel OB where new hail call registration has been made.

As a result, the hall operation panel OB displays a fellow passenger group name on the fellow passenger group display section 32 (see FIG. 5), with the result that a passenger recognizes the fellow passenger group name assigned to himself/herself by referring to the fellow passenger group display section 32.

Note that under constraints of the fellow passenger group display section 32, in a case where a fellow passenger group name has been limited in advance such as A to Z, the fellow passenger group assignment section 1 performs the fellow passenger group assignment processing by selecting a new registered fellow passenger group name from fellow passenger group names that have yet to be registered.

<Car Assignment Processing>

Figure 9:
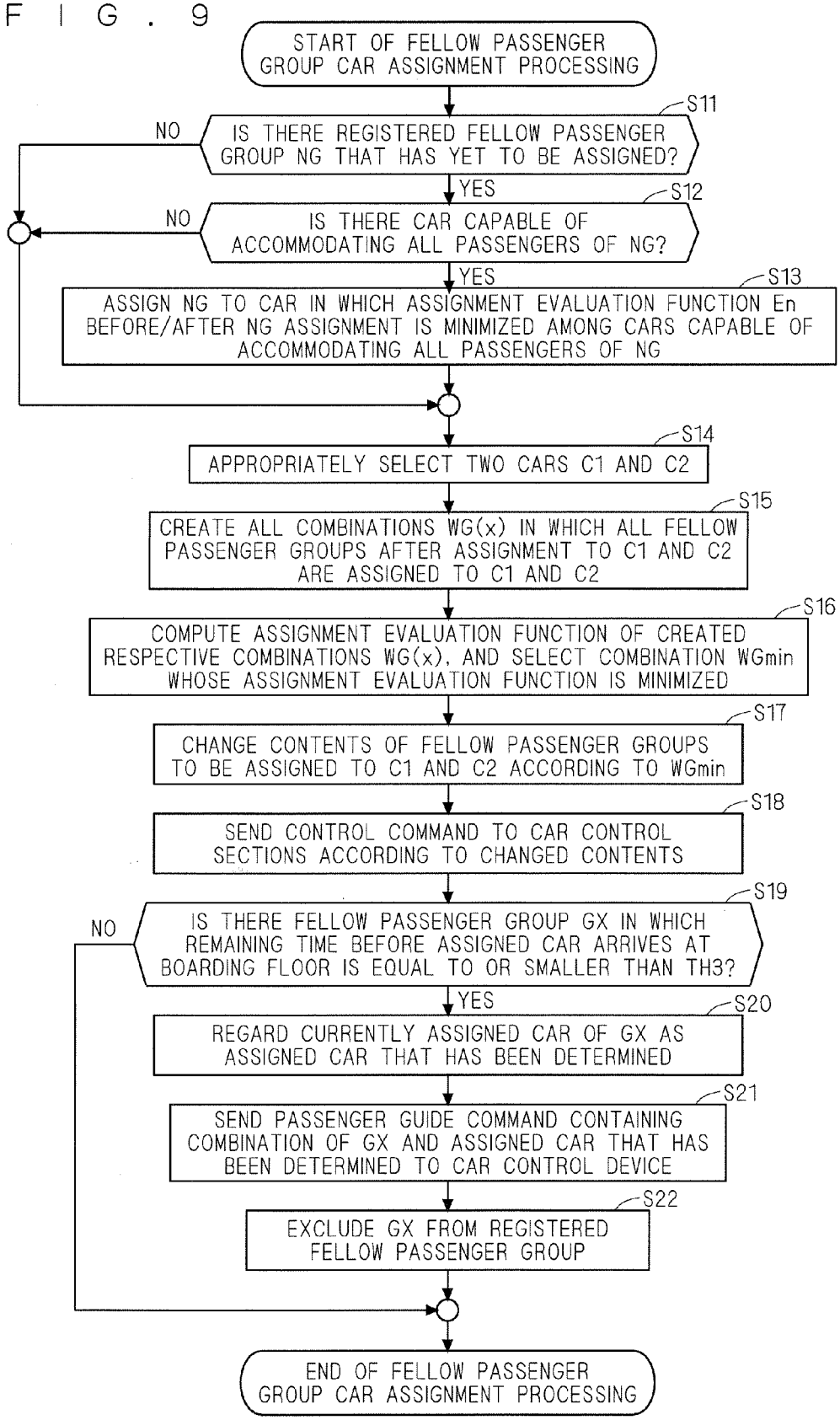
FIG. 9 is a flowchart showing car assignment processing for a fellow passenger group by a fellow passenger group car assignment section shown in FIG. 7.

FIG. 9 is a flowchart showing the car assignment processing for a fellow passenger group by the fellow passenger group car assignment section 2 shown in FIG. 7. The fellow passenger group car assignment section 2 regularly and repeatedly executes the car assignment processing described below on all of the registered fellow passenger groups.

With reference to this figure, in Step S11, it is checked whether there is a car unassigned fellow passenger group NG that has yet to be assigned a car in the registered fellow passenger group (YES) or not (NOT). The car unassigned fellow passenger group NG can be obtained by referring to the registered fellow passenger group information IM1 from the fellow passenger group information management section 3.

In a case of YES in Step S11, the process proceeds to Step S12, whereas the process proceeds to Step S14 in a case of NO.

In Step S12 executed in the case of YES in Step S11, whether there is a car capable of accommodating all passengers corresponding to the car unassigned fellow passenger group NG (YES) or not (NO) is checked in consideration of running directions over the entire running segments of all cars. In a ease where there is such a car (YES), the process proceeds to Step S13, whereas the process proceeds to Step S14 in the case where there is no such a car (NO).

In Step S13 executed in the case of YES in Step S12, in a case where it is assumed that, among cars capable of accommodating all passengers assigned to the car unassigned fellow passenger group NG, the car unassigned fellow passenger group NG is to board a car, the car in which an increment of assignment evaluation function En is minimized is assigned to the fellow passenger group NG during unassignment registration as an assigned car.

Among all cars in which a sum of the required stop number TH2 for the registered fellow passenger group of the car and the required stop number TH2 for the fellow passenger group NG during unassignment registration is equal to or smaller than a predetermined total required stop number TH4, the car in which an increment of assignment evaluation registration En is minimized may be assigned to the fellow passenger group NG during unassignment registration as an assigned car.

Then, the information obtained by bringing the assigned car into association with the car unassigned fellow passenger group NG is registered in the fellow passenger group information management section 3 as the car assigned fellow passenger group information IM2. Then, a control command is sent to the car control sections CE1 to CE3 such that cars operate according to the contents specified by the car assigned fellow passenger group information IM2. On this occasion, the registered fellow passenger group information IM1 corresponding to the car unassigned fellow passenger group NG is erased. After that, the process proceeds to Step S14.

Here, the assignment evaluation function En is computed as, for example, a sum of the waiting time of all passengers, square of waiting time, estimated probability of car passage due to full occupancy, estimated probability of incorrect prediction, and a value of a sum of the required stop number TH2 of the registered fellow passenger group of the car and the required stop number TH2 of the fellow passenger group N during unassignment registration. Note that the estimated probability of car passage due to full occupancy refers to the statistical probability that a car makes no stop due to full occupancy, which is obtained in advance. The estimated probability of incorrect prediction refers to the probability that a car other than an assigned car will arrive first.

In a case where a car for the car unassigned fellow passenger group NG could not been assigned, Steps S11 to S13 are performed again in the next car assignment processing.

The above-mentioned Steps S11 to S13 are the new assignment processing of assigning an assigned car to an unassigned fellow passenger group.

In Step S14 executed in the case of NO in Step S11 or in the case of NO in Step S12, or executed after Step S13, two cars are appropriately selected as cars C1 and C2 among all cars specified by the ear assigned fellow passenger group information IM2 registered in the fellow passenger group information management section 3.

After that, in Step S15, all fellow passenger groups that have been assigned to the cars C1 and C2 are newly assigned to the cars C1 and C2. On that occasion, there are a plurality of assignment combinations, and all combinations are created as WG (x). Note that x represents the number indicating each combination and takes values from one to the combination number N.

In a case where the fellow passenger groups are assigned to the cars C1 and C2 according to the combination WG, only the combinations in which a value of the sum of the required stop numbers TH2 of the fellow passenger groups respectively assigned to the car C1 or C2 for each car is equal to or smaller than the predetermined total required stop number TH4 may be regarded as WG(x).

Next, in Step S16, an assignment evaluation function E(WG(x)) in a case where the cars C1 and C2 are operated according to the combination WG(x) created in Step S15 is computed, and a total waiting time minimized combination WGmin, whose assignment evaluation function E(WG(x)) is minimized, is selected. The assignment evaluation function E(WG(x)) is computed as, for example, a sum of the waiting time of all passengers of the registered fellow passenger group that has been assigned and is included in the combination WG(x), square of waiting time, estimated probability of car passage due to full occupancy, estimated probability of incorrect prediction, and a value of a sum of the required stop number TH2 of the fellow passenger groups included in the combination WG respectively assigned to the car C1 or C2 for each car.

Next, all of the contents of the car assigned fellow passenger group information IM2 in which the fellow passenger groups assigned to the cars C1 and C2 are specified is changed according to the total waiting time minimized combination WGmin.

After that, in Step S18, a control command is sent to the car control sections corresponding to the cars C1 and C2 among the car control sections CE1 to CE3, so that operation is made according to the contents specified by the car assigned fellow passenger group information IM2 changed in Step S17.

The processing shown in Steps S14 to S18 described above is the assignment contents review processing of reviewing the assignment contents for the assigned fellow passenger group during a review period and modifying the assigned contents. Note that the review period is a period between the registration as the car assigned fellow passenger group information IM2 in the fellow passenger group information management section 3 and the recognition as a less-than-predetermined-time assigned fellow passenger group GX described below.

In the processing of Steps S19 to S22 performed thereafter, an assigned car is ultimately determined and an operation of guiding passengers is performed.

First, in Step S19, whether there is the less-than-predetermined-time assigned fellow passenger group GX whose remaining time before estimated arrival time of an assigned car at a boarding floor is equal to or smaller than a predetermined time TH3 (seconds) (YES) or not (NO) is determined based on the car assigned fellow group information IM2. In the case of YES, the process proceeds to Step S20, whereas the fellow passenger group car assignment processing is finished in the case of NO.

It suffices that the predetermined time TH3 is longer than the time required for a passenger to move from the position of the hall operation panel OB to the car to board for boarding. Alternatively, the moving time differs depending on an assigned car, and thus the predetermined time TH3 may be changed according to types of cars. In a case where the hall operation panel OB is installed in a place apart from the elevator hall, the predetermined time TH3 may be determined in consideration of the moving time from the position of the hall operation panel to the elevator hall. Still alternatively, the predetermined time TH3 may be set to any shorter one of a certain time period from hall call registration operation in the hall operation panel OB and the time required for a passenger to move from the position of the hall operation panel OB to a car to board for boarding.

In a case where the hall operation panel OB is mounted on the operation panel mounting stage 50 at a remote position away from the elevator hall by a predetermined distance DS as shown in FIG. 6, the predetermined time TH3 may be set to a value obtained by dividing the predetermined distance DS that is the distance between the hall operation panel OB and the elevator hall by a typical walking speed (1 m / minute) of a person. Alternatively, the predetermined time TH3 may be set to a value obtained by dividing the distance between the hall operation panel OB and the position of the car door during being assigned before being determined by a typical walking speed (1 m / minute) of a person.

In Step S20 executed in the case of YES in Step S19, the currently assigned car of the less-than-predetermined-time assigned fellow passenger group GX is regarded as an assigned car that has been determined. That is, the less-than-predetermined-time assigned fellow passenger group GX is the fellow passenger group whose review period ends, and hence the assigned car of the fellow passenger group is regarded as an assigned car that has been determined.

As described above, the termination point of the (predetermined) review period is set at the time point preceding the expected arrival time of an assigned car by a predetermined period of time. For this reason, the assignment contents review processing can be performed within the range where the operation of the elevator is not interfered.

Alternatively, the termination point of the review period may be set as the point at which a certain period of time has passed since new hall call registration provided in advance. In this case, it is possible to perform the assignment contents review processing without fail within a certain period of time that does not make passengers of an elevator feel uneasy.

Then, in Step S21, the passenger guide command CM2, which contains at least the combination information of the less-than-predetermined-time assigned fellow passenger group GX and the assigned car determined in Step S20 is sent to the car control section corresponding to the assigned car among the car control sections CE1 to CE3. Here, the passenger guide command CM2 is the command to instruct to guide passengers with fellow passenger group assigned car displays disposed in the floor and elevator shaft corresponding to the less-than-predetermined-time assigned fellow passenger group GX and an elevator shaft. In a case of the configuration in which a fellow passenger group assigned car display also displays a destination floor, the passenger guide command CM2 also contains the information on a destination floor of an assigned car. Note that the information required for the passenger guide command CM2 can be obtained from the car assigned fellow passenger group information IM2 regarding the less-than-predetermined-time assigned fellow passenger group GX.

After that, in Step S22, the less-than-predetermined-time assigned fellow passenger group GX is excluded from the registered fellow passenger group by erasing the car assigned fellow passenger group information IM2 regarding the less-than-predetermined-time assigned fellow passenger group GX from the fellow passenger group information management section 3, and then the fellow passenger group car assignment processing is finished.

Only one fellow passenger group is displayed for one car at one time by the fellow passenger group assigned car displays D1 to D3 having the configuration shown in FIG. 4, and thus the car assignment processing needs to be performed based on the relationship between a fellow passenger group and an assigned car of the first example shown in FIG. 1.

In this manner, the elevator group management system according to the present embodiment is capable of setting even passengers from the same boarding floor and to the same destination floor to different fellow passenger groups by assigning cars by the fellow passenger group car assignment section 2 in units of fellow passenger groups. Accordingly, even in a case where a large number of passengers from the same floor to the same destination floor appear, there is achieved an effect that the car assignment processing is performed appropriately without leaving any one behind.

In addition, a passenger is capable of recognizing a car to board without fail based on the fellow passenger group recognized by referring to the fellow passenger group display section 32 of the hall operation panel OB in advance, with reference to the fellow passenger group assigned car displays (D1(1) to D3(1), D1(2) to D3(2)) that display the information regarding a fellow passenger group and an assigned car (determined) in such a manner that a passenger is capable of referring to.

Therefore, in a case where the fellow passenger group assigned car display does not display a destination floor, a security effect is enhanced where a passenger is capable of boarding a car with a destination floor unknown to others.

Further, the fellow passenger group assigned car display of the elevator group management system according to the present embodiment performs the fellow passenger group assigned car display processing including display of the fellow passenger group name based on the passenger guide command. CM2 obtained from the fellow passenger group car assignment section 2.

That is, the information on the fellow passenger group of an assigned car that has yet to be determined is not displayed on the fellow passenger group assigned car display at the time point at which the fellow passenger group car assignment section 2 performs, as the car assignment processing, the assignment contents review processing (processing of Steps S14 to S18 in FIG. 9) of reviewing the assignment contents for the assigned fellow passenger group and modifying the assignment contents.

Therefore, the fellow passenger group car assignment section 2 is capable of executing the assignment contents review processing without making a passenger feel uneasy. As a result, it is possible to enhance the operational efficiency of an elevator group because the assignment contents review processing can be performed without any difficulty.

Elevator Hall (Second Configuration Example)

Figure 10:
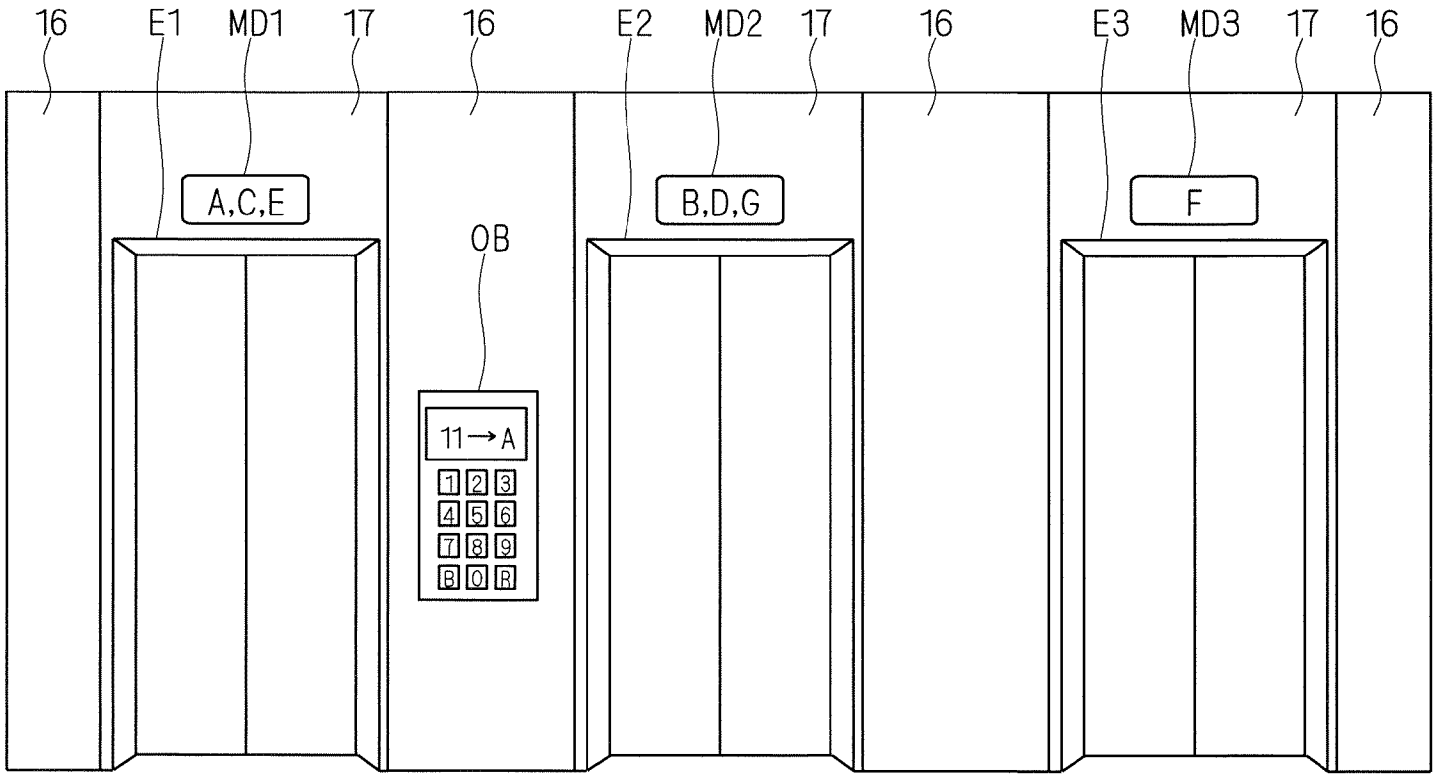
FIG. 10 is an explanatory view showing a second configuration example of the device set in proximity to the elevator hall in the elevator group management system according to the embodiment.

FIG. 10 is an explanatory view showing a second configuration example of the device set in the vicinity of the elevator hall in the elevator group management system according to the embodiment.

As shown in this figure, three car doors E1 to E3 are provided in the elevator hall, and fellow passenger group assigned ear displays MD1 to MD3 are provided in the sidewall portions 17 above the car doors E1 to E3. The hall operation panel OB is provided on the sidewall between the car doors E1 and E2.

The fellow passenger group assigned car displays MD1 to MD3 of the second configuration example shown in FIG. 10 are enabled to display a plurality of fellow passenger groups at one time, with the result that a plurality of assigned fellow passenger groups can be assigned to one assigned car as in the second and third examples shown in FIG. 2 and FIG. 3.

Accordingly, the fellow passenger group assignment section 1 of the elevator group management system according to the present embodiment is capable of assigning any of a plurality of types (four types) of fellow passenger groups exceeding a predetermined number being a car number (2) to passengers as shown in FIG. 2, and thus is capable of assigning a plurality of fellow passenger groups to one car.

Therefore, the operational efficiency of the elevator group can be enhanced further because the number of fellow passenger groups assigned to one car increases, and because the degree of freedom of assignment contents of the new assignment processing and the degree of freedom of the contents by review of the assignment contents review processing can be increased by the fellow passenger group car assignment section 2.

Elevator Hall (Third Configuration Example)

Figure 11:
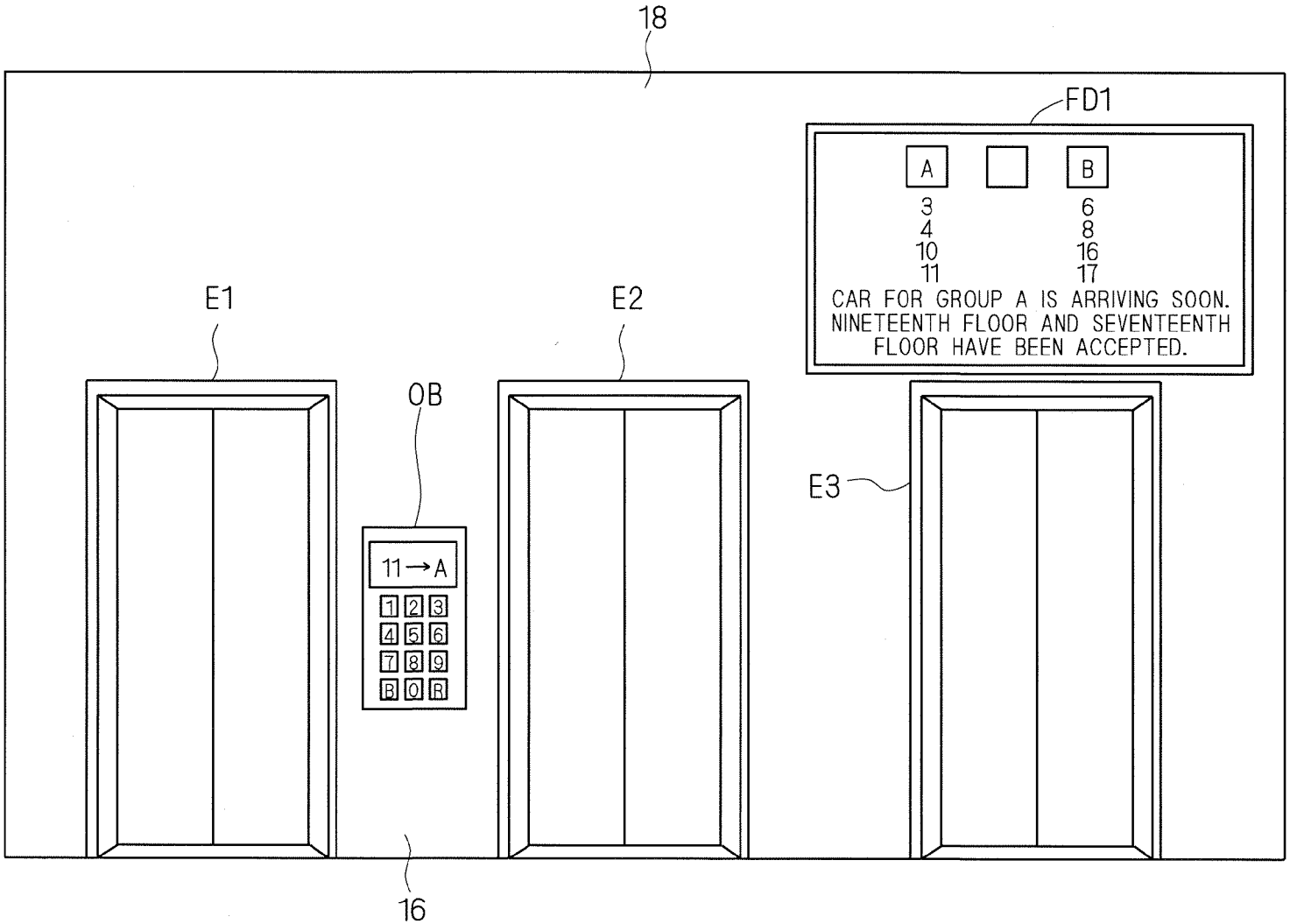
FIG. 11 is an explanatory view showing a third configuration example of the device set in proximity to the elevator hall in the elevator group management system according to the embodiment.

FIG. 11 is an explanatory view showing a third configuration example of the device set in the vicinity of the elevator hall in the elevator group management system according to the embodiment.

As shown in this figure, three car doors E1 to E3 are provided in the elevator hall, and a fellow passenger group assigned car display panel FD1 is provided along a sidewall portion 18 above the car door E3. The hall operation panel DB is provided in the sidewall portion 16 between the car doors E1 and E2. Note that the fellow passenger group assigned car display panel FD1 is formed of a large display or the like.

First Specific Configuration Example

Figure 12:
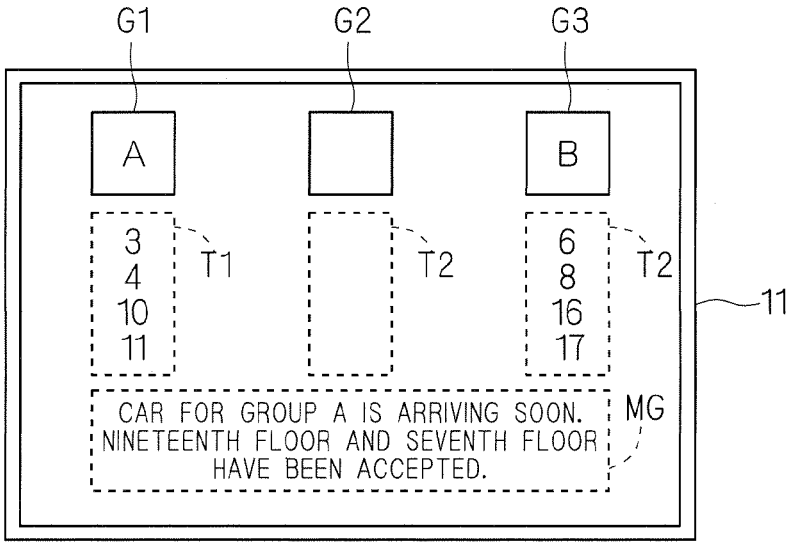
FIG. 12 is an explanatory view showing a first specific configuration example of a fellow passenger group assigned car display panel shown in FIG. 11.

FIG. 12 is an explanatory view showing a first specific configuration example of the fellow passenger group assigned car display panel FD1 shown in FIG. 11. As shown in this figure, a fellow passenger group assigned car display panel 11 displays, on fellow passenger group display sections G1 to G3 in an upper portion thereof, the names of fellow passenger groups that board cars through the car doors E1 to E3. Entering/leaving the cars of the cars No. 1 to No. 3 is enabled through the car doors E1 to E3. The fellow passenger group display sections G1 to G3 produce a display by arranging symbols in squares side by side in a map form so as to correspond to actual positions of cars, and display the name of fellow passenger groups assigned to the symbols in squares.

Further, the fellow passenger group assigned car display panel 11 displays, on destination floor display sections T1 to T3 at the center thereof, destination floors on which boarding is made through the car doors E1 to E3. The destination floors are displayed on the destination floor display sections T1 to T3 by displaying destination floors in the areas of the destination floor display sections T1 to T3, which correspond to the positions of the assigned cars that have been determined.

In the example shown in FIG. 12, as shown in the fellow passenger group display section G1 and the destination floor display section T1, display is made such that a fellow passenger group A is assigned to the car No. 1 and the destination floors are the third floor, fourth floor, tenth floor and eleventh floor. Similarly, as shown in the fellow passenger group display section G3 and the destination floor display section T3, display is made such that a fellow passenger group B is assigned to the car No. 3 and the destination floors are the sixth floor, eighth floor, sixteenth floor and seventeenth floor.

Note that the fellow passenger groups and the destination floors are displayed on the fellow passenger group display sections G1 to G3 and the destination floor display sections T1 to T3 based on the passenger guide command CM2 sent to the corresponding car control section when the fellow passenger group car assignment section 2 executes Step S21 of the car assignment processing shown in FIG. 9.

Further, the fellow passenger group assigned car display panel 11 displays a message saying "Car for group A is arriving soon. (Hall call registration of) nineteenth floor and seventh floor have been accepted." on a message display section MG in a lower portion thereof. Accordingly, with reference to the message display section MG, a passenger is capable of recognizing the information on the car immediately before arrival and the fact that destination floors of an assigned group during registration with an unassigned car have been accepted. In order to display that the destination floors of the assigned group during registration have been accepted, it is required for the passenger guide command CM2 to contain the contents of the registered fellow passenger group information IM1 as well.

Second Specific Configuration Example

Figure 13:
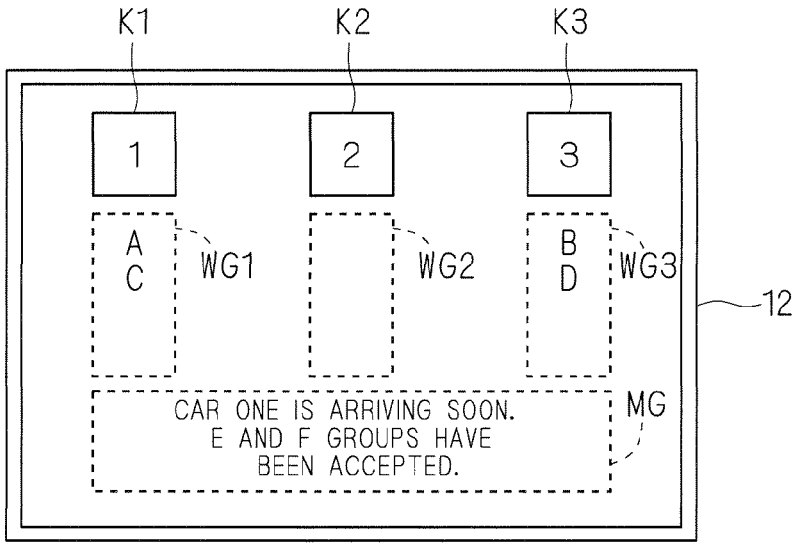
FIG. 13 is an explanatory view showing a second specific configuration example of the fellow passenger group assigned car display panel shown in FIG. 11.

FIG. 13 is an explanatory view showing a second specific configuration example of the fellow passenger group assigned car display panel FD1 shown in FIG. 11. As shown in this figure, a fellow passenger group assigned car display panel 12 displays, on car display sections K1 to K3 in an upper portion thereof, car identification numbers indicating any of the car doors E1 to E3 through which boarding is made. Entering/leaving the cars No. 1 to No. 3 is enabled through the car doors E1 to E3. The car display sections K1 to K3 produce a display by arranging symbols in squares side by side in a map form so as to correspond to actual positions of cars, and display the numbers of corresponding cars in the symbols in squares.

Further, the fellow passenger group assigned car display panel 12 displays, on fellow passenger group display sections WG1 to WG3 at the center thereof, fellow passenger group names that board cars through the car doors E1 to E3. The fellow passenger group names are displayed on the fellow passenger group display sections WG1 to WG3 by displaying fellow passenger group names in the areas of the fellow passenger group display sections WG1 to WG3, which correspond to the positions of the assigned cars that have been determined.

In the example shown in FIG. 13, as shown on the car display section K1 and the fellow passenger group display section WG1, display is made such that fellow passenger groups A and C are assigned to the car No. 1. Similarly, as shown on the car display section K3 and the fellow passenger group display section WG3, display is made such that fellow passenger groups B and D are assigned to the car No. 3.

Note that the fellow passenger groups are displayed on the fellow passenger group display sections WG1 to WG3 based on the passenger guide command CM2 sent to the corresponding car control section when the fellow passenger group car assignment section 2 executes Step S21 of the car assignment processing shown in FIG. 9.

Further, the fellow passenger group assigned car display panel 12 displays a message saying "Car No. 1 is arriving soon. E and F groups have been accepted." on a message display section MG in a lower portion thereof. Accordingly, with reference to the message display section MG, a passenger is capable of recognizing the information on the car immediately before arrival and the fact that the names of the assigned groups during registration with unassigned cars have been accepted.

Third Specific Configuration Example

Figure 14:
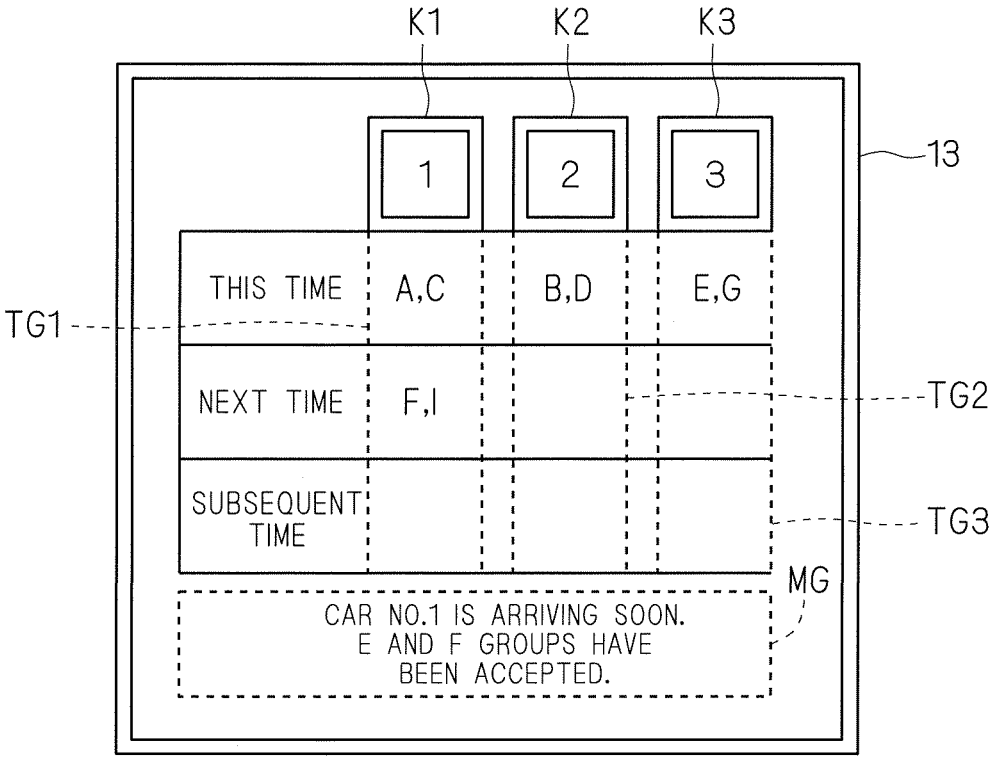
FIG. 14 is an explanatory view showing a third specific configuration example of the fellow passenger group assigned car display panel shown in FIG. 11.

FIG. 14 is an explanatory view showing a third specific configuration example of the fellow passenger group assigned car display panel FD1 shown in FIG. 11. As in the third example shown in FIG. 3, a fellow passenger group assigned car display panel 13 shown in FIG. 14 assumes a case where assigned cars are assigned according to arrival turns such as this arrival, the next arrival and the subsequent arrival.

As shown in this figure, the fellow passenger group assigned car display panel 13 displays, on car display sections K1 to K3 in an upper portion thereof, car identification numbers indicating any of the car doors E1 to E3 trough which boarding is made. Entering/leaving the cars No. 1 to No. 3 is enabled through the car doors E1 to E3. The car display sections K1 to K3 produce a display by arranging symbols in squares side by side in a map form so as to correspond to actual positions of cars, and display the numbers of the corresponding cars in the symbols in squares.

Further, the fellow passenger group assigned car display panel 13 displays, on fellow passenger group display sections TG1 to TG3 at the center thereof, fellow passenger group names that board cars through the car doors E1 to E3 according to arrival turns (this time, next time, subsequent time). The fellow passenger group names are displayed on the fellow passenger group display sections TG1 to TG3 by displaying fellow passenger group names in the areas of the fellow passenger group display sections TG1 to TG3, which correspond to the positions of the assigned cars that have been determined and the types of arrival turns.

In the example shown in FIG. 14, as shown on the car display section K1 and the fellow passenger group display section TG1, display is made such that groups A and C are assigned to this arrival of the car No. 1 and that fellow passenger groups F and I are assigned to at the next arrival thereof. Similarly, as shown on the car display section K2 and the fellow passenger group display section TG2, display is made such that fellow passenger groups B and D are assigned to this arrival of the car No. 2. Similarly, as shown on the car display section K3 and the fellow passenger group display section TG3, display is made such that fellow passenger groups E and G are assigned to this arrival of the car No. 3.

Note that the fellow passenger groups are displayed on the fellow passenger group display sections TG1 to TG3 based on the passenger guide command CM2 sent to the corresponding car control section when the fellow passenger group car assignment section 2 executes Step S21 of the car assignment processing shown in FIG. 9.

Further, the fellow passenger group assigned car display panel 13 displays a message saying "Car No. 1 is arriving soon. E and F groups have been accepted." on a message display section MG in a lower portion thereof. Accordingly, with reference to the message display section MG, a passenger is capable of recognizing the information on the car immediately before arrival and the fact that the names of the assigned groups during registration with unassigned cars have been accepted.

The fellow passenger group car assignment section 2 in the elevator group management system according to the present embodiment executes, on at least one fellow passenger group, the car assignment processing of assigning a combination of any of a plurality of cars and arrival turns thereof as an assigned car, to thereby display, on the fellow passenger group assigned car display panel 13, a fellow passenger group name and information on an assigned car and its arrival turns.

Accordingly, even in a case where passengers exceeding a sum of capacities of a plurality of ears use an elevator group, there is achieved an effect that the car assignment processing can be performed without leaving any one behind.

Note that in a case where the arrival turns are also taken into consideration, the fellow passenger group car assignment section 2 needs to regard the same car of different arrival turns as different cars and perform the processing of Steps S12 and S13.

Further, the passenger guide command CM2 in Step S21 is required to contain information regarding the arrival turns.

Elevator Hall (Fourth Configuration Example)

Figure 15:
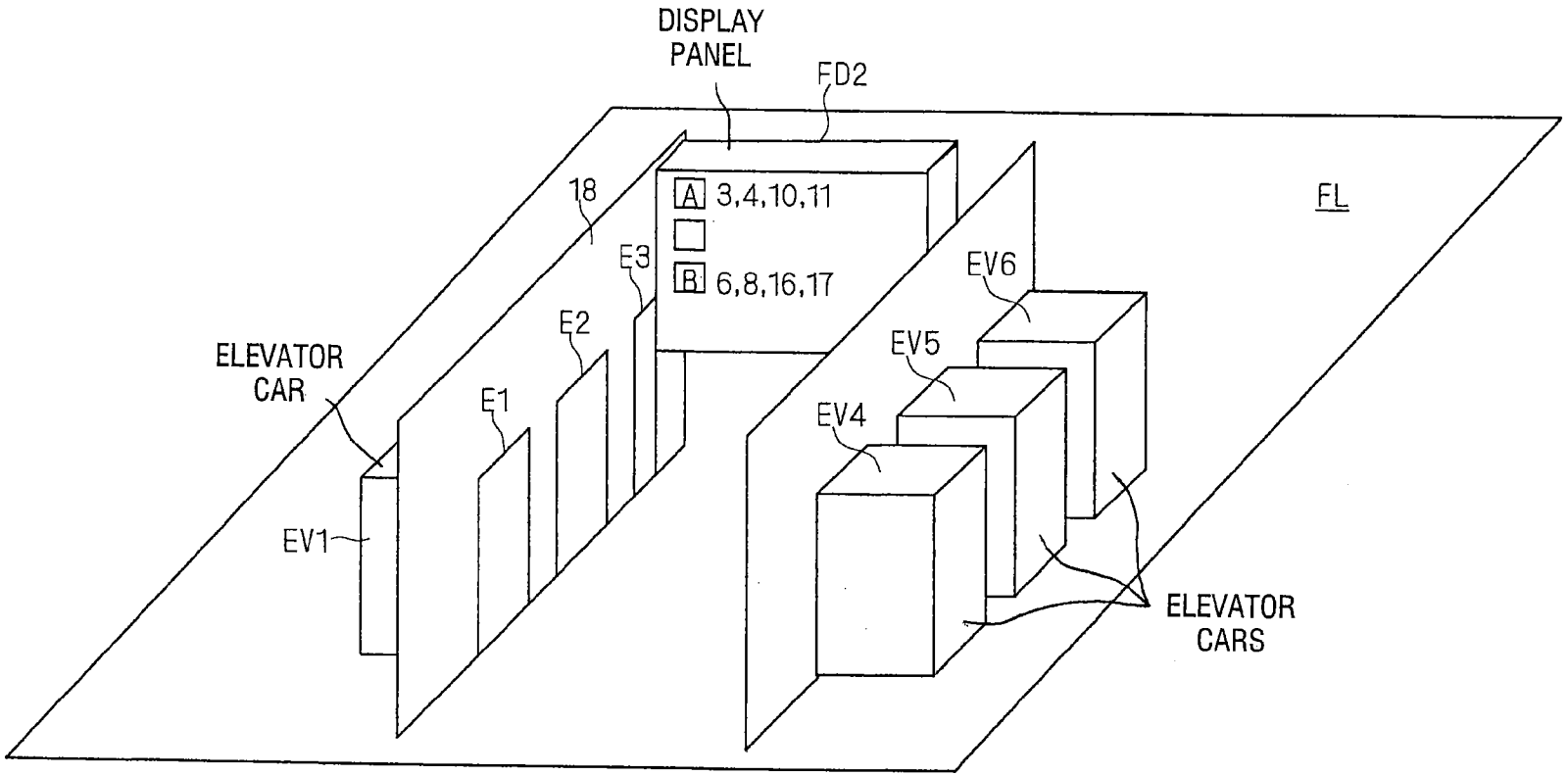
FIG. 15 is an explanatory view showing a fourth configuration example of the device set in proximity to the elevator hall of the elevator group management system according to the embodiment.

FIG. 15 is an explanatory view showing a fourth configuration example of the device set in the vicinity of the elevator hall in the elevator group management system according to the embodiment.

As shown in this figure, six ear doors E1 to E6 (EV4 to EV6 are not shown) are provided in the elevator hall, and passengers are capable of entering/leaving elevators (cars) No. 1 to No. 6, EV1 to EV6 (EV2 and EV3 are not shown), through car doors E1 to E6.

A fellow passenger group assigned car display panel FD2 is provided in the sidewall portion 18 in the vicinity of the car door E. This fellow passenger group assigned car display panel FD2 is provided to stand perpendicularly to the sidewall portion 18. Note that the fellow passenger group assigned car display panel FD2 is formed of a large display or the like.

First Specific Configuration Example

Figure 16:
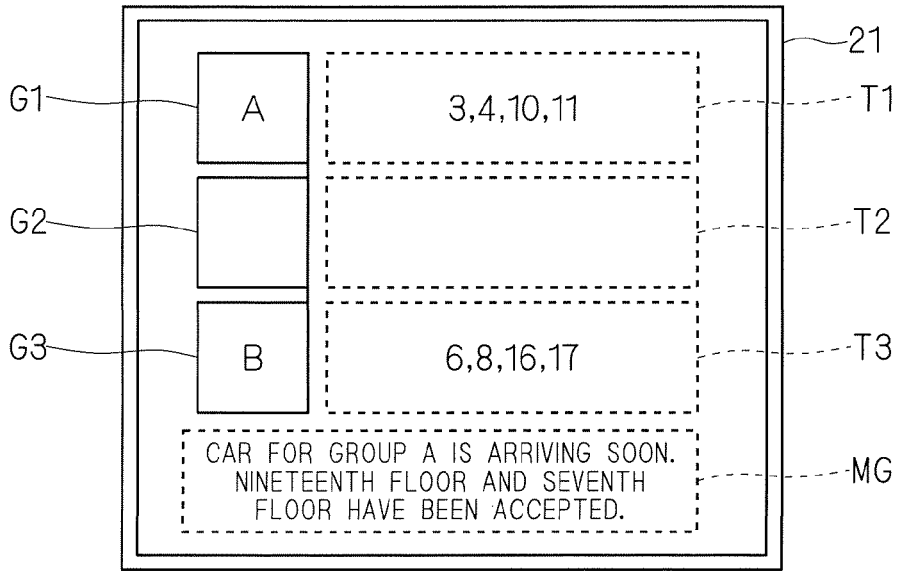
FIG. 16 is an explanatory view showing a first specific configuration example of the fellow passenger group assigned car display panel shown in FIG. 15.

FIG. 16 is an explanatory view showing a first specific configuration example of the fellow passenger group assigned car display panel FD2 shown in FIG. 15. As shown in this figure, a fellow passenger group assigned car display panel 21 displays, on fellow passenger group display sections G1 to G3 in the left portion thereof, the names of fellow passenger groups that board cars through the car doors E1 to E3. As described above, entering/leaving the cars No. 1 to No. 3, or the cars EV1 to EV3, is enabled through the car doors E1 to E3. The fellow passenger group display sections G1 to G3 produce a display by vertically arranging symbols in squares in a map form so as to correspond to actual positions of cars, and display the names of fellow passenger groups assigned to the symbols in squares.

Further, the fellow passenger group assigned car display panel 21 displays, on destination floor display sections T1 to T3 at the center thereof, destination floors on which boarding is made through the ear doors E1 to E3. The destination floors are displayed on the destination floor display sections T1 to T3 by displaying destination floors in the areas of the destination floor display sections T1 to T3, which correspond to the positions of the assigned cars that have been determined.

Other features are similar to those of the first specific configuration example of the fellow passenger group assigned car display panel FD1 shown in FIG. 12.

Second Specific Configuration Example

Figure 17:
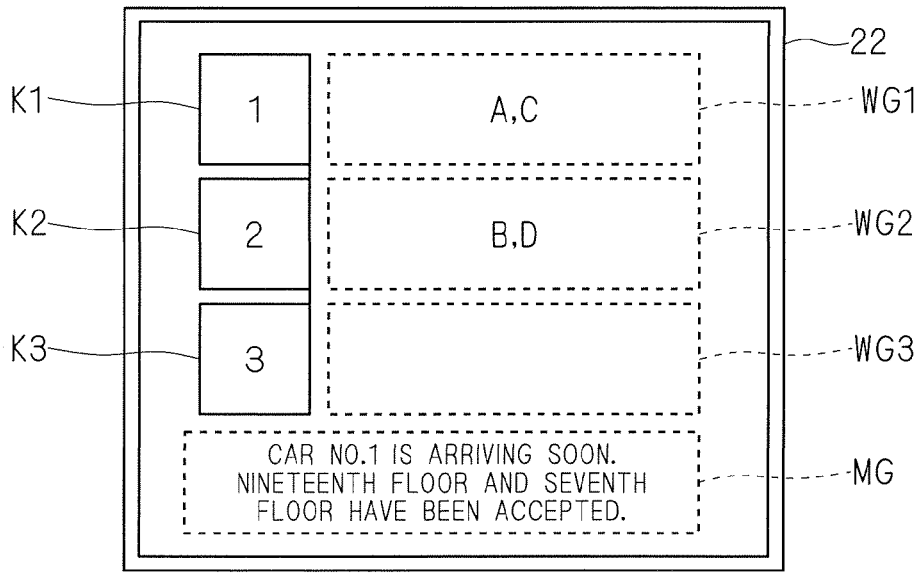
FIG. 17 is an explanatory view showing a second specific configuration example of the fellow passenger group assigned car display panel shown in FIG. 15.

FIG. 17 is an explanatory view showing a second specific configuration example of the fellow passenger group assigned car display panel FD2 shown in FIG. 15. As shown in this figure, a fellow passenger group assigned car display panel 22 displays, on car display sections K1 to K3 in the left portion thereof, the car identification numbers for boarding through the car doors E1 to E3. Further, the fellow passenger group assigned car display panel 22 displays, on fellow passenger group display sections WG1 to WG3 at the center thereof, the fellow passenger group names for boarding through the car doors E1 to E3. The fellow passenger group names are displayed on the fellow passenger group display sections WG1 to WG3 by displaying fellow passenger group names in the areas of the fellow passenger group display sections WG1 to WG3, which correspond to the positions of the assigned cars that have been determined.

Other features are similar to those of the second specific configuration example of the fellow passenger group assigned car display panel FD1 shown in FIG. 13.

Third Specific Configuration Example

Figure 18:
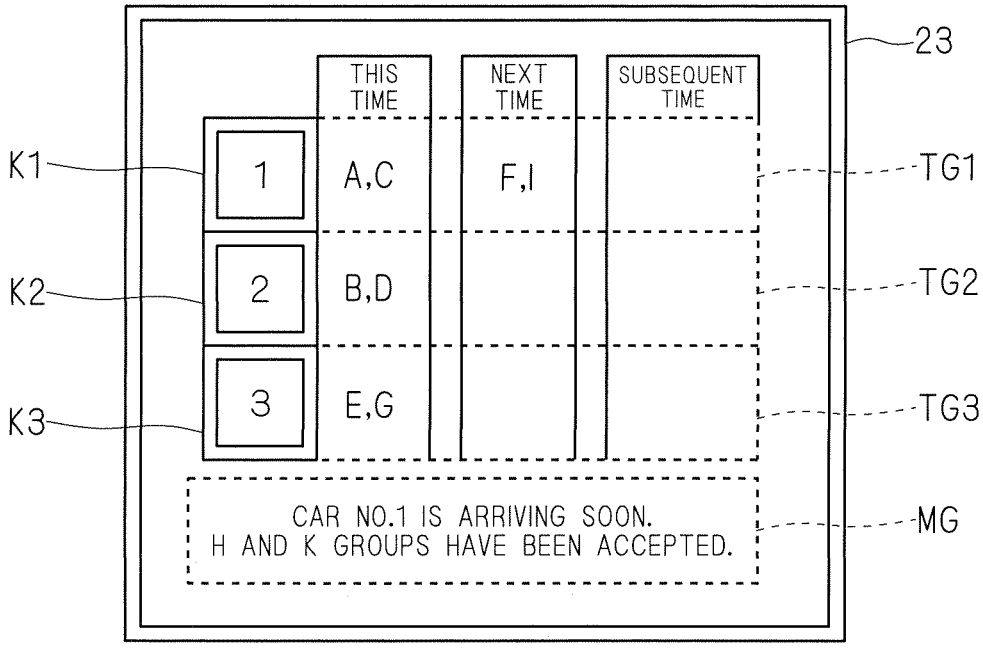
FIG. 18 is an explanatory view showing a third specific configuration example of the fellow passenger group assigned car display panel shown in FIG. 15.

FIG. 18 is an explanatory view showing a third specific configuration example of the fellow passenger group assigned car display panel FD2 shown in FIG. 15. As in the third example shown in FIG. 3, a fellow passenger group assigned car display panel 23 shown in FIG. 18 assumes a case where assigned cars are assigned according to arrival turns such as this arrival, the next arrival and the subsequent arrival.

As shown in this figure, the fellow passenger group assigned car display panel 23 displays, on car display sections K1 to K3 in the left portion thereof, the car identification numbers for boarding through the car doors E1 to E3.

Further, the fellow passenger group assigned car display panel 23 displays, on fellow passenger group display sections TG1 to TG3 at the center thereof, fellow passenger group names that board cars through the car doors E1 to E3 according to arrival turns (this time, next time, subsequent time). The fellow passenger group names are displayed on the fellow passenger group display sections TG1 to TG3 by displaying fellow passenger group names in the areas of the fellow passenger group display sections TG1 to TG3, which correspond to the positions of the assigned cars that have been determined and the types of arrival turns.

Other features are similar to those of the third specific configuration example of the fellow passenger group assigned car display panel FD1 shown in FIG. 14.

While the invention has been shown and described in detail, the foregoing description is in all aspects illustrative and not restrictive. It is therefore understood that numerous modifications and variations can be devised without departing from the scope of the invention.

The invention claimed is:

1. An elevator group management system assigning, in an elevator group including a plurality of cars, any of said plurality of cars to passengers in response to demands of the passengers to manage the cars, the elevator group management system comprising:

a hall call registration section located in an elevator hall or in proximity thereto and configured to perform a hall call registration of registering a destination floor by the passengers;

a fellow passenger group assignment section assigning passengers to fellow passenger groups upon each said hall call registration being made, and causing a fellow passenger group display section to display fellow passenger group information thereof, said fellow passenger group display section being disposed in proximity to said hall call registration section; and a fellow passenger group car assignment section executing car assignment processing of assigning at least one fellow passenger group to any of said plurality of cars as an assigned car generating a passenger guide command indicating at least a correspondence relationship between said fellow passenger group and said assigned car, wherein the assignment to said fellow passenger groups is performed by said fellow passenger group assignment section so that the number of passengers included in said fellow passenger group falls within a predetermined number and a required number of stops for the passengers included in said fellow group falls within a predetermined range.

2. The elevator group management system according to claim 1, further comprising fellow passenger group assigned car display sections performing, based regarding said passenger guide command, fellow passenger group assigned car display processing of displaying information regarding said fellow passenger group and said assigned car in a manner so as to be referenced by the passengers.

3. The elevator group management system according to claim 1, wherein said car assignment processing by said fellow passenger group car assignment section comprises:

new assignment processing of assigning an assigned car to said fellow passenger group to which an assigned car has not been assigned;

assignment contents review processing of reviewing, in a predetermined review period, assignment contents for said fellow passenger group to which said assigned car has been assigned and modifying the assignment contents; and assigned car determination processing of determining, after a lapse of said predetermined review period, said assigned car of said fellow passenger group after the assignment and obtaining said passenger guide command indicating said correspondence relationship between said fellow passenger group and said assigned car after the determination of the assigned car.

4. The elevator group management system according to claim 3, wherein a termination point of said predetermined review period is set at a time point after a lapse of a predetermined period of time from said hall call registration provided in advance.

5. The elevator group management system according to claim 3, wherein a termination point of said predetermined review period is set at a time point before a predicted arrival time of said assigned car by a certain period of time.

6. The elevator group management system according to claim 1, wherein:

said plurality of cars include a predetermined number of cars; and said fellow passenger group assignment section is capable of assigning, to passengers, any of a plurality of types of fellow passenger groups exceeding said predetermined number.

7. The elevator group management system according to claim 2, wherein:

said car assignment processing by said fellow passenger group car assignment section includes processing of classifying said plurality of cars further according to an arrival turn, assigning a combination of any of said plurality of cars and an arrival turn thereof as said assigned car to at least one of said fellow passenger groups, and generating said passenger guide command indicating a correspondence relationship of said fellow passenger group, said assigned car and the arrival turn thereof; and said fellow passenger group assigned car display processing by said fellow passenger group assigned car display section includes processing of displaying, based on said passenger guide command, information regarding said fellow passenger group, said assigned car and the arrival turn thereof.

* * * * *